US005289612A

United States Patent [19]

Glenn, III

[11] Patent Number: 5,289,612

[45] Date of Patent: Mar. 1, 1994

[54] NOISE REDUCTION SYSTEM FOR HARD BODY VACUUM

[75] Inventor: William K. Glenn, III, Anderson, S.C.

[73] Assignee: Ryobi Motor Products Corporation, Easley, S.C.

[21] Appl. No.: 929,310

[22] Filed: Aug. 13, 1992

[51] Int. Cl.[5] ..... A47L 9/00

[52] U.S. Cl. ..... 15/326; 15/351

[58] Field of Search ..... 15/326

[56] References Cited

U.S. PATENT DOCUMENTS

| | | | |
|---|---|---|---|
| 2,297,209 | 9/1942 | Geduhn et al. . | |
| 2,300,266 | 10/1942 | Smellie | 15/326 |
| 2,340,437 | 2/1944 | Stoner . | |
| 2,342,905 | 2/1944 | Smellie | 15/326 X |
| 2,941,232 | 6/1960 | Milbourne . | |
| 3,218,783 | 11/1965 | Ripple . | |
| 3,344,588 | 10/1967 | Szabo . | |
| 4,280,245 | 7/1981 | Hiester . | |
| 4,330,899 | 5/1982 | Miller et al. . | |
| 4,361,928 | 12/1982 | Schulz . | |
| 4,418,443 | 12/1983 | Fischer . | |
| 4,435,877 | 3/1984 | Berfield . | |
| 4,446,594 | 5/1984 | Watanabe et al. . | |
| 4,617,034 | 10/1986 | Ikezaki et al. . | |
| 4,970,753 | 11/1990 | Herron, Jr. . | |

FOREIGN PATENT DOCUMENTS

| | | | |
|---|---|---|---|
| 34563 | 3/1977 | Japan | 15/326 |

*Primary Examiner*—Chris K. Moore

*Attorney, Agent, or Firm*—Brooks & Kushman

[57] ABSTRACT

A noise reduction system is provided for use with an upright vacuum cleaner. The noise reduction system is intended to be used with a rigid filter bag body-type vacuum cleaner wherein a fixed housing and a removable cover cooperate to enclose a cavity. The cavity houses a dirty air inlet which is in communication with a head assembly of a vacuum cleaner. A filter bag is contained within the cavity and cooperates with the dirty air inlet so as to filter exhaust air and retain debris contained therein. A muffler is contained within the cavity and spaced from the dirty air inlet. The muffler cooperates with the housing to form a baffle chamber The muffler defines a plurality of air entrance apertures which allow air to flow from the cavity into the baffle chamber. Both the muffler and the housing have a series of baffles formed generally parallel aligned which are interleaved and juxtaposed when the housing and the muffler cooperate to form the baffle chamber. A series of baffles redirect exhaust air entering the baffle chamber, thereby reducing air flow energy and the associated noise as air exhausted through the exhaust vents to atmosphere.

13 Claims, 3 Drawing Sheets

NOISE REDUCTION SYSTEM FOR HARD BODY VACUUM

TECHNICAL FIELD

This invention relates to a noise reduction system, and more particularly to a noise reduction system for use with an upright vacuum cleaner.

BACKGROUND ART

In a vacuum cleaner a primary source of noise is the exhaust air flow. A goal of vacuum cleaner manufacturers is to minimize the exhaust air flow noise to reduce as much as possible the annoyance to the vacuum cleaner operator.

Vacuum cleaner manufactures have taken different approaches to constructing noise reduction systems. These noise reduction systems have been utilized in both conventional and up right vacuum cleaners. One approach is taught in U.S. Pat. No. 2,340,437 to Stoner and in U.S. Pat. No. 4,617,034 to Ikezaki et al., which each disclose a vacuum leaner having a resonant muffler formed within the cleaner. These resonant chambers are designed to attenuate the sound waves over a certain range of frequency.

An alternative approach to reducing noise may be seen in U.S. Pat. No. 3,218,783 to Ripple and U.S. Pat. No. 4,446,594 to Watanabe et al., which disclose the use of sound absorbing material lining the exhaust passageway as a means of reducing exhaust noise.

U.S. Pat. No. 4,970,753 to Herron, Jr. assigned to Ryobi Motor Products Corp., discloses a cartridge which is provided for selective installation within the vacuum cleaner. Exhaust air flows through the cartridge which is configured to interfere with the free flow of the exhaust. The cartridge is a two-part unit wherein each part includes an array of parallel baffle plates which are interleaved with the array of baffle plates of the other part juxtaposed to the baffle plates of the opposing part to form a complete air flow baffle cartridge. The baffle plates for a labyrinth causing the air to undergo a plurality of changes of direction prior to leaving the vacuum cleaner, thereby reducing energy from the air flow.

The present invention is directed to improving know noise-reduction systems for use in upright vacuum cleaners.

SUMMARY OF THE INVENTION

An object of the present invention is to provide an upright vacuum cleaner with an improved noise reduction system.

A feature of the present invention is to provide a baffle chamber having a series of baffles for baffling the exhaust noise prior to venting the same to atmosphere.

A further object of the present invention is to provide an upright vacuum cleaner having a head assembly and an electric motor for driving a blower. A rigid filter bag body is provided which is attached in upright relation to the head assembly. The rigid filter bag body has a fixed housing and a removable cover which defines an enclosed cavity therebetween. The housing is provided with a dirty air inlet in communication with the blower and an exhaust vent for venting filtered exhaust air to atmosphere. A muffler is provided which is affixed to the housing in a region of the exhaust vent which defines a baffle chamber therebetween. The muffler has an air entrance spaced from the exhaust vent which requires the exhaust air exiting the cavity to flow through the baffle chamber. A series of baffles are provided which are located within the baffle chamber between the air entrance and the exhaust vent for reducing exhaust air noise.

Another object of the present invention is to provide a noise reduction system for use with an upright vacuum cleaner. The noise reduction system has a first member and a second member which cooperate to form a rigid housing. The housing defines a cavity which encloses a dirty air inlet. Either the first member or the second member defines an exhaust vent for venting filtered exhaust air to atmosphere. A muffler is provided which cooperates with either the first member or the second member to form a baffle chamber. The muffler defines an air entrance spaced a distance from the exhaust vent requiring exhaust air exiting the cavity to flow through the baffle chamber. A series of baffles located are within the baffle chamber between the air entrance and the exhaust vent to reduce exhaust air noise.

Still another object of the present invention is to provide an upright vacuum cleaner having a head assembly and an electric motor for driving a blower. The vacuum cleaner has a body defining an exhaust vent. A cover is provided which cooperates with the body to form a rigid housing which is attached in upright relation to the head assembly. The housing defines an enclosed cavity. A dirt tube is provided which is located within the housing and in communication with the head assembly and the exhaust vent. The dirt tube has a muffler integrally formed thereon. The muffler is affixed to the body adjacent the exhaust vent so as to define a baffle chamber therebetween. The muffler has formed therein an air entrance spaced from the exhaust vent requiring exhaust air exiting the cavity to flow through the baffle chamber. A series of baffles are located within the baffle chamber between the air entrance and the exhaust vent for reducing exhaust air noise.

The above objects, features, and advantages of the present invention are readily apparent from the following detailed description of the invention when taken in connection with the accompanying drawings.

DETAILED DESCRIPTION OF THE INVENTION

The preferred embodiment shown in FIGS. 1 through 4 illustrates an upright rigid body vacuum cleaner 10.

Figure 1:
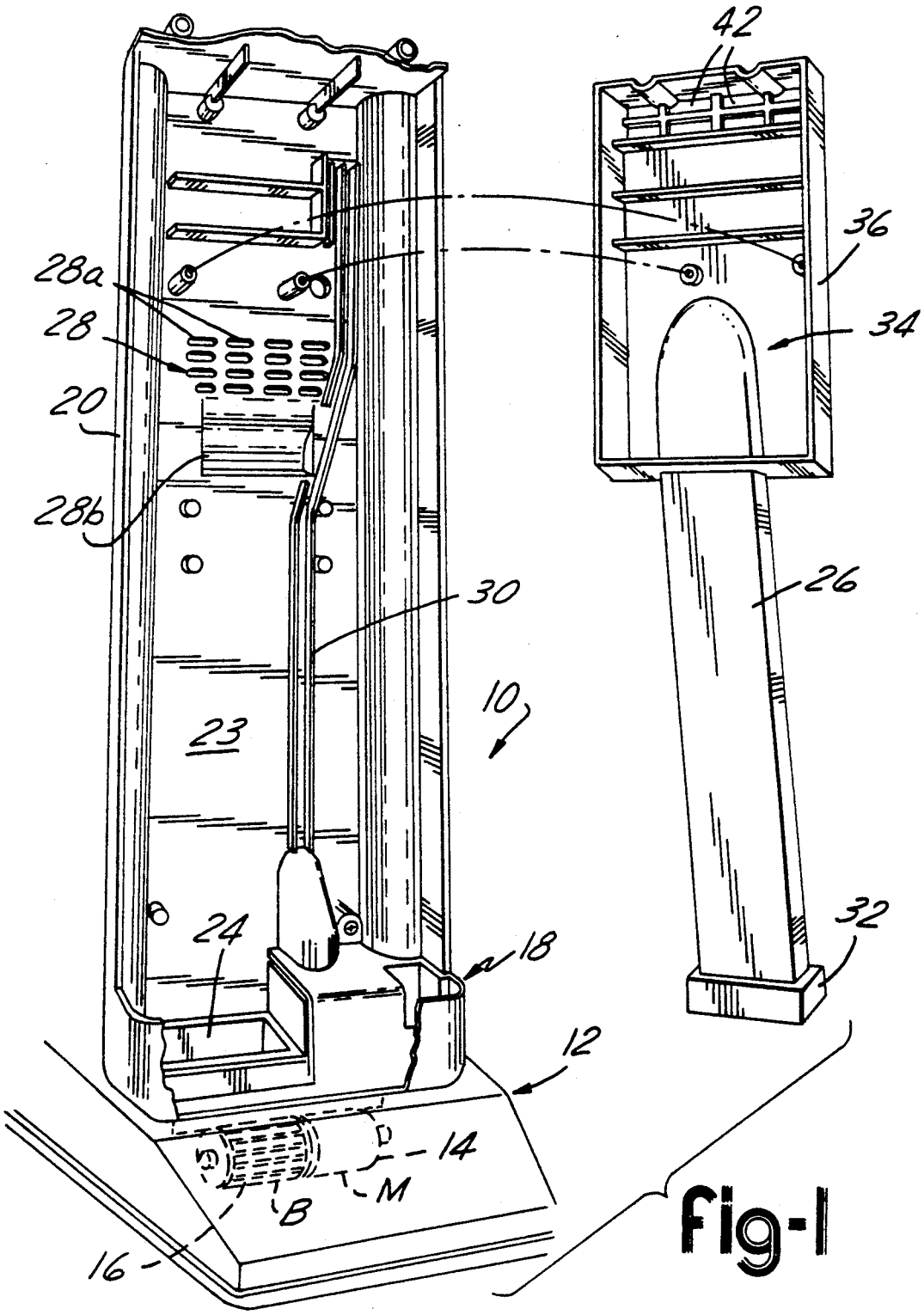
FIG. 1 is a perspective view of an upright vacuum cleaner with the cover, the muffler and the dirty air inlet removed from the housing, showing the internal elements of the present invention.
Figure 2:
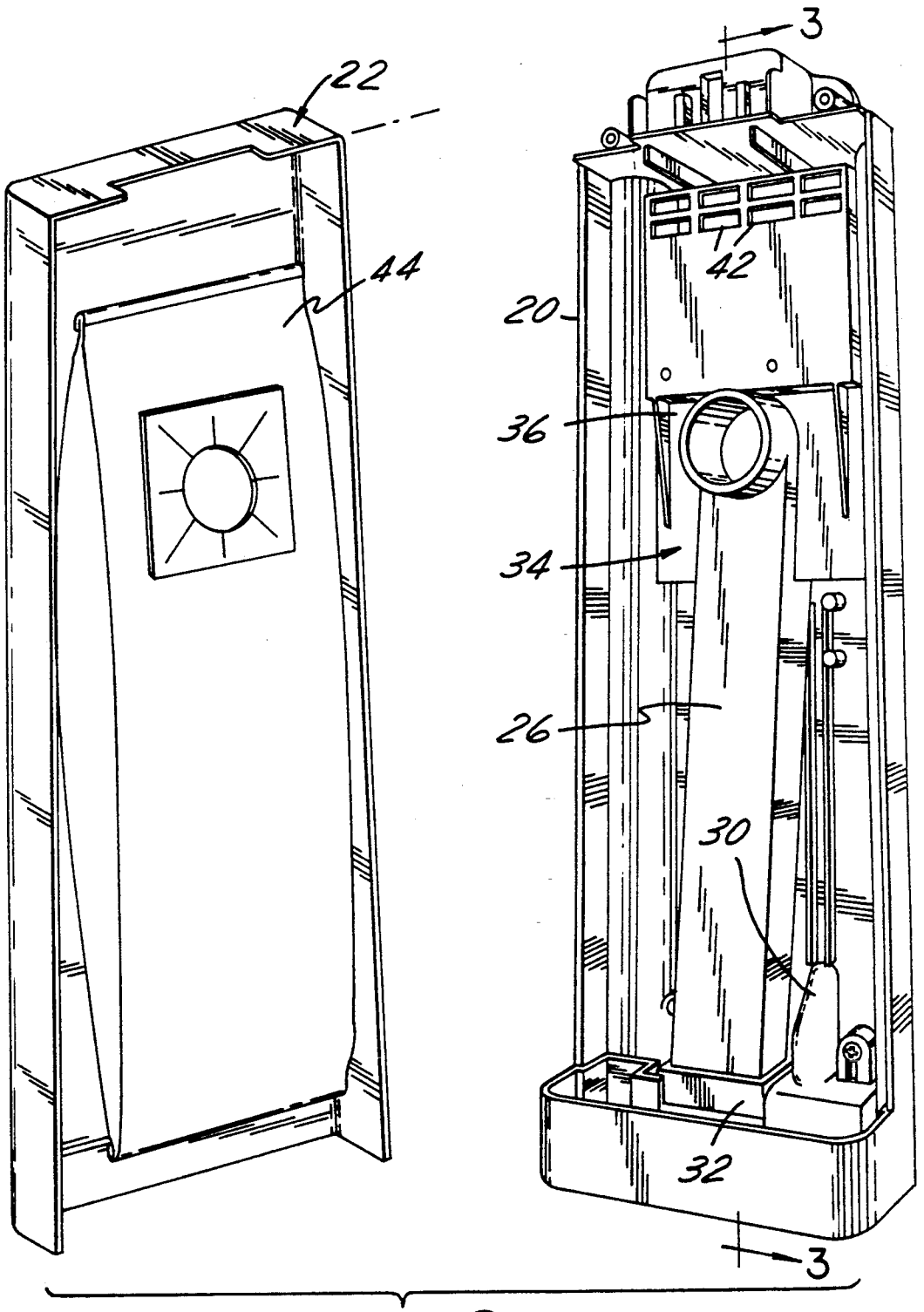
FIG. 2 is a perspective view of the rigid filter bag body showing the cover and filter bag removed exposing the muffler and dirty air inlet positioned against the housing in accordance with the present invention.

As shown in FIG. 1, the vacuum cleaner 10, has a head assembly 12 which contains an electric motor 14 and a blower 16. A rigid filter bag body 18 cooperates with the head assembly 12. FIG. 2 shows that the rigid filter bag body 18 is formed from a housing 20 and a removable cover 22. A cavity 23 is formed therebetween.

Figure 4:
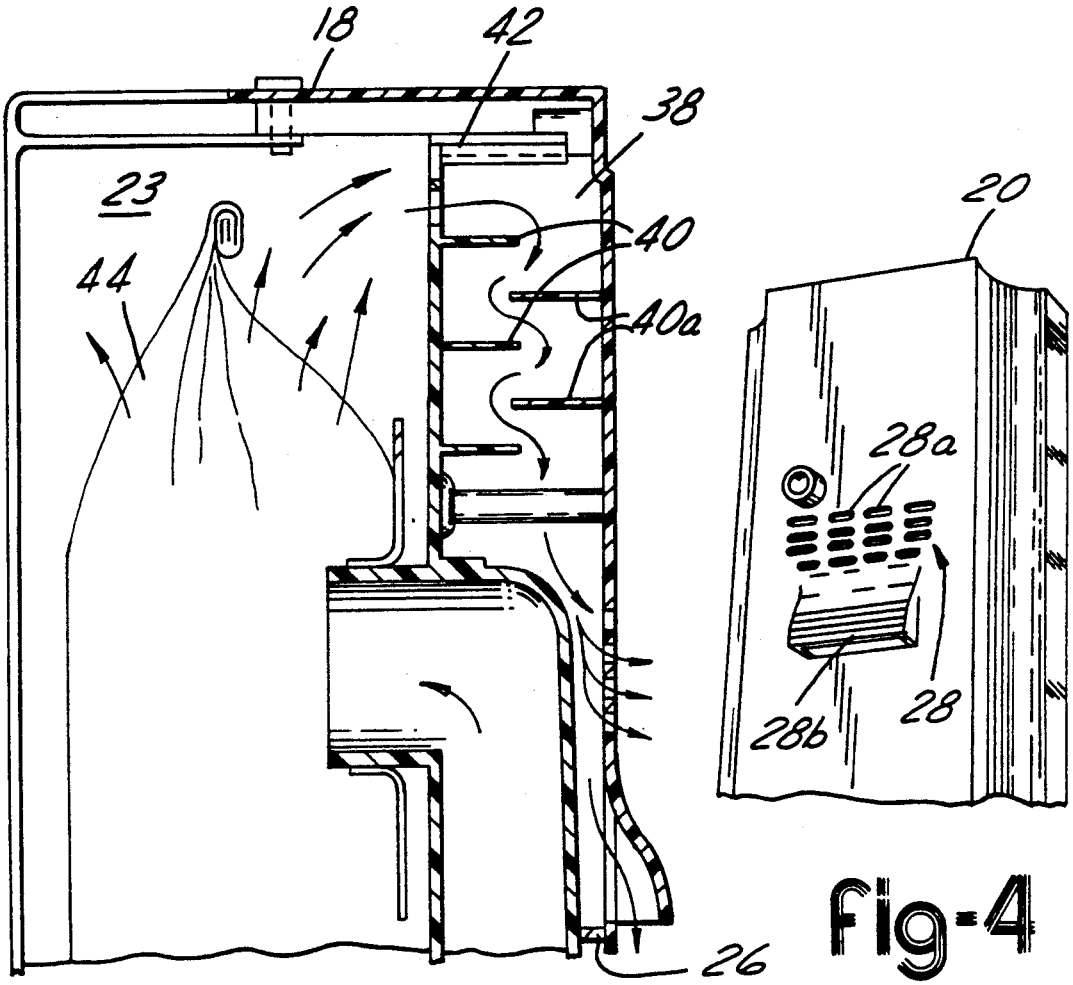
FIG. 4 is a perspective view of the housing showing the exhaust vent in accordance with the present invention.

The housing 20 defines an air aperture 24 which cooperates with a dirt tube or dirty air inlet 26 to allow dirty air to flow from the blower 16 in the head assembly 12 into the rigid filter bag body 18. The housing 20 also defines exhaust vents 28 for venting filtered exhaust air to atmosphere. The exhaust vents 28 comprises both a plurality of apertures 28*a* in the housing 20 as well as a directional duct 28*b* for directing vented exhaust air. FIG. 4 best illustrates the exhaust vents 28 formed within the housing 20. The housing 20 also has a wire guide 30 which directs the wires contained within the vacuum cleaner 10.

Also shown in FIG. 1 is the dirty air inlet 26. The air inlet 26 has a mounting portion 32 located at one end and a muffler 34 integrally formed at the other end of the dirty air inlet 26. The muffler 34 is longitudinally aligned with the air inlet 26 such that the muffler 34 extends upward in longitudinal alignment from the air inlet 26. The muffler 34 has a flange 36 which surrounds the muffler and cooperates with the housing 20 such that the muffler 34 and the housing 20 form a baffle chamber 38 when the muffler 34 is affixed to the housing 20. The muller has a series of baffles 40 which are connected to the muffler 34 in parallel alignment generally perpendicularly to the longitudinal axis of the air inlet 26. The baffles 40 extend across the muffler 34 and contact the flange 36, the baffles 40 project away from the muffler 34 toward the housing 20.

Figure 3:
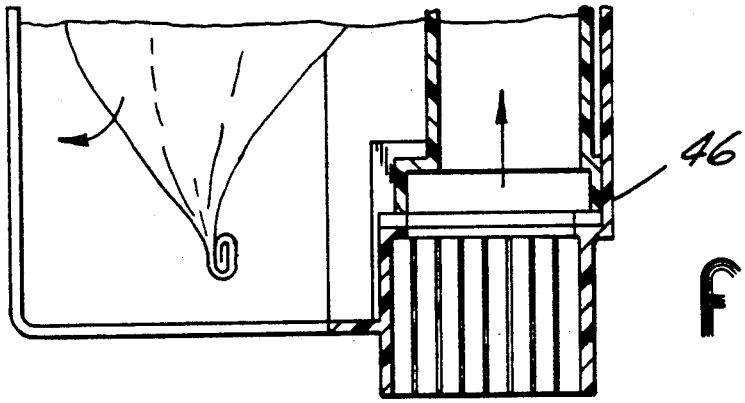
FIG. 3 is a cross-section of the invention showing the housing and cover cooperating to form a cavity, and showing major elements of the present invention.

As shown in FIGS. 2 and 3, the housing 20 also has a series of baffles 40*a* which are similar in shape and size to the baffles 40 affixed to the muffler 34. When the muffler 34 and housing 20 are joined, the baffles 40 and 40*a* are interleaved and juxtaposed relative to each to ensure that the exhaust air travels in an S-shaped pattern through the baffle chamber to reduce the exhaust air noise. The flange 36 on the muffler 34 cooperate with the housing 20 in such a fashion so as to ensure that the baffle chamber is generally air sealed. The muffler 34 has a plurality of air entrance apertures 42 which allow exhaust air to move from the cavity 23 into the baffle chamber 38.

FIG. 2 also shows a filter bag 44 connected to the air inlet 26. The filter bag 42 is a porous material which filters dirty air and traps debris contained in the dirty air passing therethrough. As shown in FIG. 3, the muffler 34 is situated within the cavity 23 such that air must go through the air entrance apertures 42 in the muffler 34 prior to exiting the rigid filter bag body 18 through the exhaust vents 28. The exhaust vents 28 are best shown in FIGS. 1 through 3.

As shown in FIG. 2, the air inlet 26 has a rubber seal 46 which is located between the mounting portion 32 of the air inlet 26 and the air aperture 24 of the head assembly 12 to ensure that dirty air is not leaked into the cavity 23.

In operation, as depicted in FIG. 3, the blower 16 forces dirty air into the dirty air inlet 26 which pushes the dirty air into the filter bag 44. The filter bag 44 filters the dirty air of debris, retaining the debris in the filter bag 44. The filtered exhaust air then moves through the air entrance apertures 42 of the muffler 34 into the baffle chamber 38. The baffles 40 and 40*a* cause the exhaust air to be redirected a number of times which decreases the energy and related noise of the exhaust air. The exhaust air then is vented to atmosphere through the exhaust vents 28. Exhaust air travels from the cavity 23 through the baffle chamber 38 and is vented to atmosphere because the air pressure within the cavity 23 is greater than the external air pressure. Accordingly, the exhaust air travels toward the lower pressure, i.e. from the cavity 23 to atmosphere through the exhaust vents 28.

While the best mode for carrying out the invention has been described in detail, those familiar with the art to which this invention relates will recognize various alternative designs and embodiments for practicing the invention as defined by the following claims.

What is claimed is:

1. An upright vacuum cleaner having a head assembly and an electric motor for driving a blower, said vacuum cleaner comprising:

a rigid filter bag body attached in upright relation to said head assembly and having a fixed housing and a removable cover defining an enclosed cavity therebetween, said housing provided with a pressurized dirty air inlet in communication with said blower, and an exhaust vent for venting filtered exhaust air to atmosphere;

a muffler affixed to said housing within said cavity in the region of said exhaust vent to define a baffle chamber between said muffler and said housing, said muffler forming an air entrance spaced from said exhaust vent requiring exhaust air exiting said cavity to flow through said baffle chamber; and a series of baffles located within said baffle chamber between said air entrance and said exhaust vent for reducing exhaust air noise emitted from said upright vacuum cleaner.

2. An upright vacuum cleaner according to claim 1 wherein said series of baffles includes a first set of baffle plates extending in parallel spaced relationship from said housing toward said muffler and a second set of baffle plates extending in parallel spaced relationship from said muffler toward said housing, said first and second sets of baffle plates are configured so as to be interleaved in said baffle chamber requiring exhaust air flow to take a serpentine path prior to being vented to atmosphere through said exhaust vent.

3. An upright vacuum cleaner according to claim 1 wherein said baffle chamber is located within said housing so as to be located between said dirty air inlet and said exhaust vent.

4. An upright vacuum cleaner according to claim 1 wherein said dirty air inlet has a first end adapted to communicate with said head assembly and said dirty air inlet has a second end adapted to cooperate with a filter bag.

5. An upright vacuum cleaner according to claim 1 wherein said exhaust vent is formed in said housing and adapted to direct filtered exhaust air away from said housing to atmosphere.

6. A noise reduction system for use with an upright vacuum cleaner having a floor mounted head assembly and a pivotably attached rigid upper body housing containing a pressurized filter bag, said system comprising:

a first member and a second member cooperating to form a rigid upper body housing, said housing defining an enclosed cavity for supporting a filter, a dirty air inlet in communication with the head assembly and an exhaust vent formed in one of said first or second members for venting exhaust air to atmosphere;

a muffler cooperating with said member having the exhaust vent formed therein to form a baffle chamber located within said housing cavity, said muffler defining an air entrance spaced from said exhaust vent requiring exhaust air exiting said housing cavity to flow through said baffle chamber; and a series of baffles located within said baffle chamber forming a circuitous flow path between said air entrance and said exhaust vent for reducing exhaust air noise emitted from said upright vacuum cleaner.

7. A noise reduction system according to claim 6 wherein said series of baffles includes a first set of baffle plates extending in parallel spaced relationship from said housing toward said muffler and a second set of baffle plates extending in parallel spaced relationship from said muffler toward said housing, said first and second sets of baffle plates are configured so as to be interleaved in said baffle chamber requiring exhaust air flow to take a serpentine path prior to being vented to atmosphere through said exhaust vent.

8. A noise reduction system according to claim 6 wherein said baffle chamber is located within said housing so as to be located between said dirty air inlet and said exhaust vent.

9. A noise reduction system according to claim 6 wherein said dirty air inlet has a first end adapted to communicate with said head assembly and said dirty air inlet has a second end adapted to cooperate with a filter bag.

10. An upright vacuum cleaner having a head assembly and an electric motor for driving a blower, said vacuum cleaner comprising:

a body defining an exhaust vent;

a cover cooperating with said body to form a rigid housing attached in upright relation to said head assembly, said housing defining an enclosed cavity therein;

a dirt tube located within said housing and in communication with said head assembly and said exhaust vent, said dirt tube having a muffler integrally formed thereon, said muffler affixed to said body adjacent said exhaust vent to define a baffle chamber therebetween, said muffler having formed therein an air entrance spaced from said exhaust vent requiring exhaust air exiting said cavity to flow through said baffle chamber; and a series of baffles located within said baffle chamber between said air entrance and said exhaust vent for reducing exhaust air noise.

11. An upright vacuum cleaner according to claim 10 wherein said series of baffles includes a first set of baffle plates extending in parallel spaced relationship from said housing toward said muffler and a second set of baffle plates extending in parallel spaced relationship from said muffler toward said housing, said first and second sets of baffle plates are configured so as to be interleaved in said baffle chamber requiring exhaust air flow to take a serpentine path prior to being vented to atmosphere through said exhaust vent.

12. An upright vacuum cleaner according to claim 10 wherein said baffle chamber is located within said housing so as to be located between said dirt tube and said exhaust vent.

13. An upright vacuum cleaner of claim 10 wherein said dirt tube has a first end adapted to communicate with said head assembly and said dirt tube has a second end adapted to cooperate with a filter bag.

* * * * *